US011549669B2

(12) United States Patent
Vartan

(10) Patent No.: US 11,549,669 B2
(45) Date of Patent: Jan. 10, 2023

(54) SUPPORT FOR LIFE-LIGHT

(71) Applicant: Daniel R. Vartan, Kearny, NJ (US)

(72) Inventor: Daniel R. Vartan, Kearny, NJ (US)

( * ) Notice: Subject to any disclaimer, the term of this patent is extended or adjusted under 35 U.S.C. 154(b) by 130 days.

(21) Appl. No.: 17/092,729

(22) Filed: Nov. 9, 2020

(65) Prior Publication Data

US 2021/0054992 A1 Feb. 25, 2021

Related U.S. Application Data

(63) Continuation-in-part of application No. 16/158,339, filed on Oct. 12, 2018, now Pat. No. 10,830,422.

(60) Provisional application No. 62/572,626, filed on Oct. 16, 2017.

(51) Int. Cl.

| | |
|---|---|
| ***F21V 21/06*** | (2006.01) |
| ***F21S 9/02*** | (2006.01) |
| ***F21V 17/02*** | (2006.01) |
| ***F21V 17/12*** | (2006.01) |

(52) U.S. Cl.

CPC ..... *F21V 21/06* (2013.01); *F21S 9/02* (2013.01); *F21V 17/02* (2013.01); *F21V 17/12* (2013.01)

(58) Field of Classification Search

CPC ..... F21V 21/06; F21V 17/02; F21V 17/12; F21S 9/02

See application file for complete search history.

(56) References Cited

U.S. PATENT DOCUMENTS

| | | | | |
|---|---|---|---|---|
| 2,706,610 | A * | 4/1955 | Roberts | F21V 21/145 248/168 |
| 4,208,703 | A * | 6/1980 | Orr | F16M 11/38 362/109 |
| 5,319,365 | A * | 6/1994 | Hillinger | B60Q 7/00 248/121 |
| 5,684,452 | A * | 11/1997 | Wang | B60Q 7/00 248/188.6 |
| 5,934,628 | A * | 8/1999 | Bosnakovic | F16M 11/30 248/177.1 |
| 6,994,449 | B2 * | 2/2006 | Kim | F21L 4/005 362/110 |
| 7,063,444 | B2 * | 6/2006 | Lee | F21V 17/007 362/285 |

(Continued)

*Primary Examiner* — Leah Simone Macchiarolo
(74) *Attorney, Agent, or Firm* — Michael Foycik

(57) ABSTRACT

A stable base supports a handle portion of an emergency light. The stable base has a stand portion and a base portion, which are separated from each other. The stand portion is assembled about the handle portion of the light, and has two pivotable legs extending therefrom. The handle portion itself together with the base portion forms a third leg. The base portion is formed from an upper and a lower portion assembled with a connecting member. A plate is formed on the lower base portion. In a first configuration, the legs are generally transverse to an axis of the emergency light handle, to form a tripod-like support on approximately level ground. In a second configuration, the legs are disposed downwardly so as to be generally parallel to the axis of the handle portion, such that the tips of the legs are disposed downward and are adapted to be inserted into the ground to resist high winds and gusts. In a third configuration, the legs are raised upward such that the tips of the legs are disposed adjacent to the handle portion of the emergency light, and are adapted to be inserted into a container for storage or shipping.

10 Claims, 14 Drawing Sheets

(56) References Cited

U.S. PATENT DOCUMENTS

2011/0228524 A1* 9/2011 Greer ..... F21V 21/06
362/190

* cited by examiner

SUPPORT FOR LIFE-LIGHT

CROSS REFERENCE TO RELATED APPLICATIONS

This application claims the priority of Provisional Application No. 62/572,626 filed on Oct. 16, 2017, inventor Daniel R. Vartan, entitled "EMERGI-SAFE EMERGENCY LIGHT AND SYSTEM"; and also claims the priority of U.S. Utility patent application Ser. No. 16/158,339 filed on Oct. 12, 2018, inventor Daniel R. Vartan, entitled "LIFE-LIGHT". The entire disclosure of the above-noted provisional patent application is hereby incorporated by reference thereto, in its entirety; and the entire disclosure of the above-noted Utility patent application is hereby incorporated by reference thereto, in its entirety.

STATEMENT REGARDING FEDERALLY SPONSORED RESEARCH OR DEVELOPMENT

Not applicable.

FIELD OF THE INVENTION

The present invention relates to emergency lighting, warning lights, and portable flashlights.

BACKGROUND OF THE INVENTION

It is a problem in the art to provide a stable support for a portable battery operated, multi-function emergency light in the form of a flare, a flashlight, a signal light, a work light, and/or a lantern. It is also a problem in the art to provide a safer (no sparks, no flames, and no noxious smoke), reusable, more versatile, and user friendly alternative to the use of incendiary strike flares which only last a maximum of 30 minutes, having a stable base.

It is a further problem in the art to provide a stable base that can be configured to selectively be anchored in the ground using its three legs, so as to support a light of the type mentioned above, and also can be selectively placed above the ground supported by its three legs.

It is a further problem in the art to provide a foldable, reconfigurable device of the type described above, which is relatively easy to assemble and disassemble.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a support for a device for providing lighting and warning lights during an emergency, and for other uses as well.

The base supports the device for providing lighting. The device for providing lighting is a novel battery operated, multi-function LED emergency flare/flashlight/signal light/work light/lantern intended to be a safer (no sparks, no flames, and no noxious smoke), reusable, more versatile, and user friendly alternative to the use of incendiary strike flares which only last a maximum of 30 minutes versus this product's 60+ hours per set of batteries.

The invention is directed to a stable base and support for a portable battery operated, multi-function emergency light as described above which is in the form of a flare, a flashlight, a signal light, a work light, and/or a lantern. The stable base and support can be configured to selectively be anchored in the ground using its three legs, so as to support a light of the type mentioned above, and also can be selectively placed above the ground supported by its three legs.

The present invention additionally provides a foldable, reconfigurable stable base and support for the device of the type described above, which is relatively easy to assemble and disassemble.

A stable base supports a handle portion of an emergency light. The stable base has three legs which can be placed selectively in any of three configurations. In a first configuration, the legs are generally transverse to an axis of the emergency light handle, to form a tripod-like support on approximately level ground. In a second configuration, the legs are disposed downwardly so as to be generally parallel to an axis of the handle portion of the emergency light, and wherein the tips of the legs are disposed away from the handle portion of the emergency light, and are adapted to be inserted into the ground to form a strong immobile support to resist high winds and gusts. In a third configuration, the legs are raised so as to be disposed upwardly so as to be generally parallel to an axis of the handle portion of the emergency light, and wherein the tips of the legs are disposed adjacent to the handle portion of the emergency light, and are adapted to be inserted into a container for storage or shipping.

The present invention is directed to a stable base for supporting an emergency light in an upright leaning position on a surface, comprising in combination:

- a handle portion of the emergency light, said handle portion having an upper end, a lowermost end, a central portion disposed between said upper end and said lowermost end; and said handle portion having a longitudinal axis;
- a stand portion adapted to support said handle portion in an upright leaning position; said stand portion having a first body portion and a second body portion; said second body portion having at least two legs adapted to support said handle in an upright leaning position when said stand is mounted on said central portion of said handle portion; said first body portion and said second body portion being disposed on opposite sides of said central portion of said handle portion; and at least one fastener for connecting said first body portion to said second body portion, to retain said central portion of said handle portion between said first body portion and said second body portion; and
- a base portion adapted to receive said lowermost end of said handle portion to support said handle portion on the support surface.

The invention further includes a base portion comprising an upper base portion and a lower base portion.

The invention further includes an upper base portion adapted to be a battery cover, and a battery end cap connected to said upper base portion, and a lower base portion.

The invention further is directed to a lowermost end of said handle portion having external threading; and wherein said upper base portion has internal threading adapted for threaded engagement with said threaded lower end of said handle portion, to secure said handle portion to said upper base portion.

Further, said lower base portion is cup-shaped and receives said battery cover in frictional engagement therein.

The battery cover has a polygonal surface, to prevent rolling of the battery cover when lying on the surface.

Further, the battery cover is a magnetic member, adapted to secure said handle portion to a metallic surface when said handle portion is separated from said lower base portion.

Additionally, said lower base portion is composed of TPV material, and is resiliently deformable to grip and retain said battery cover.

The stand portion has a first configuration and a second configuration; where in said first configuration said at least two legs are extended away from said handle portion to provide a stable base, and in said second configuration said at least two legs are pivoted toward said handle portion and extend generally parallel to said longitudinal axis of said handle portion.

Additionally, said second body portion of said stand portion includes a first pivot portion and a second pivot portion which respectively support said two legs pivotably in relation to said handle portion.

Other objects and advantages of the present invention will be more readily apparent from the following detailed description when read in conjunction with the accompanying drawings.

DETAILED DESCRIPTION OF THE INVENTION

Figure 1:
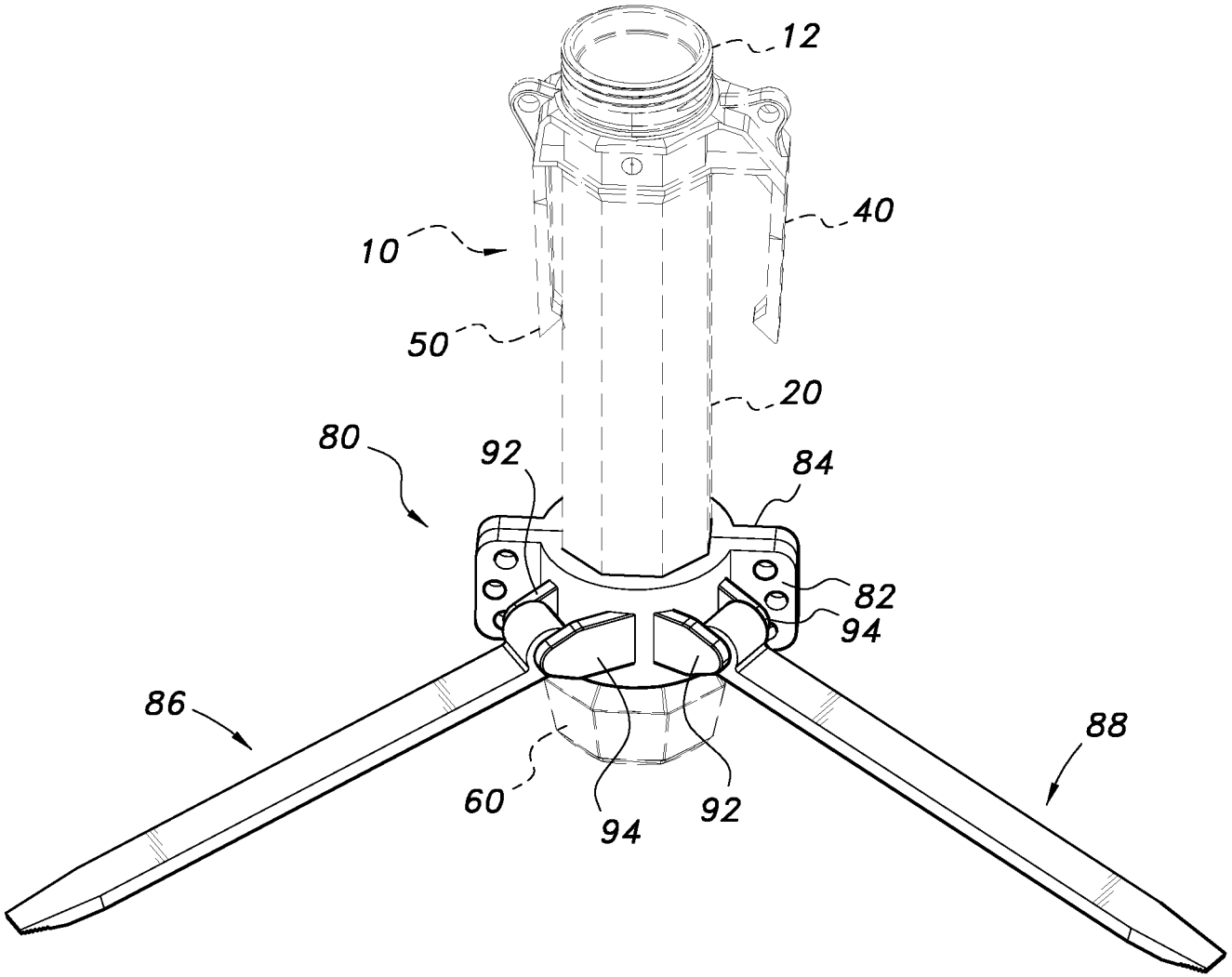
FIG. 1 is a perspective environmental view of a stable base and support for a device such as a handle portion of an emergency light which is shown in phantom outline, the stable base being in a first configuration with its legs outwardly directed, according to the present invention.

FIG. 1 is a perspective environmental view of a stable base and support 80 for a device 10 such as a handle portion of an emergency light which is shown in phantom outline. The stable base 80 has three legs 86, 88, and 90 (shown in FIG. 2). The stable base 80 is shown in a first configuration with its legs 86, 88, and 90 being outwardly directed.

The base 80 includes a first bracket 82 and a second bracket 84 which is preferably secured to the first bracket by bolts or screws (not shown). The brackets 82 and 84 can also be secured together by adhesive, ultrasonic welding, or welding, among other examples.

FIG. 1 shows a handle portion 10 of an emergency light according to the present invention. The emergency light will include a light emitting portion or lamp (shown in FIG. 10 as a payload 400). The handle portion 10 includes a body portion 20 having an octagonal cross section such that it includes eight flat walls. The handle portion 10 includes an uppermost threaded portion 12, and includes a first arm 40 extending a specified distance from the body portion 20 and extending parallel thereto. The handle portion includes a second arm 50 closely spaced to the body portion 20 and likewise extending parallel to the body portion 20. The arms 40 and 50 are adapted to be used for hanging the handle portion 10 on any type of supports which are capable of being engaged by one of the arms 40 or 50.

Figure 10:
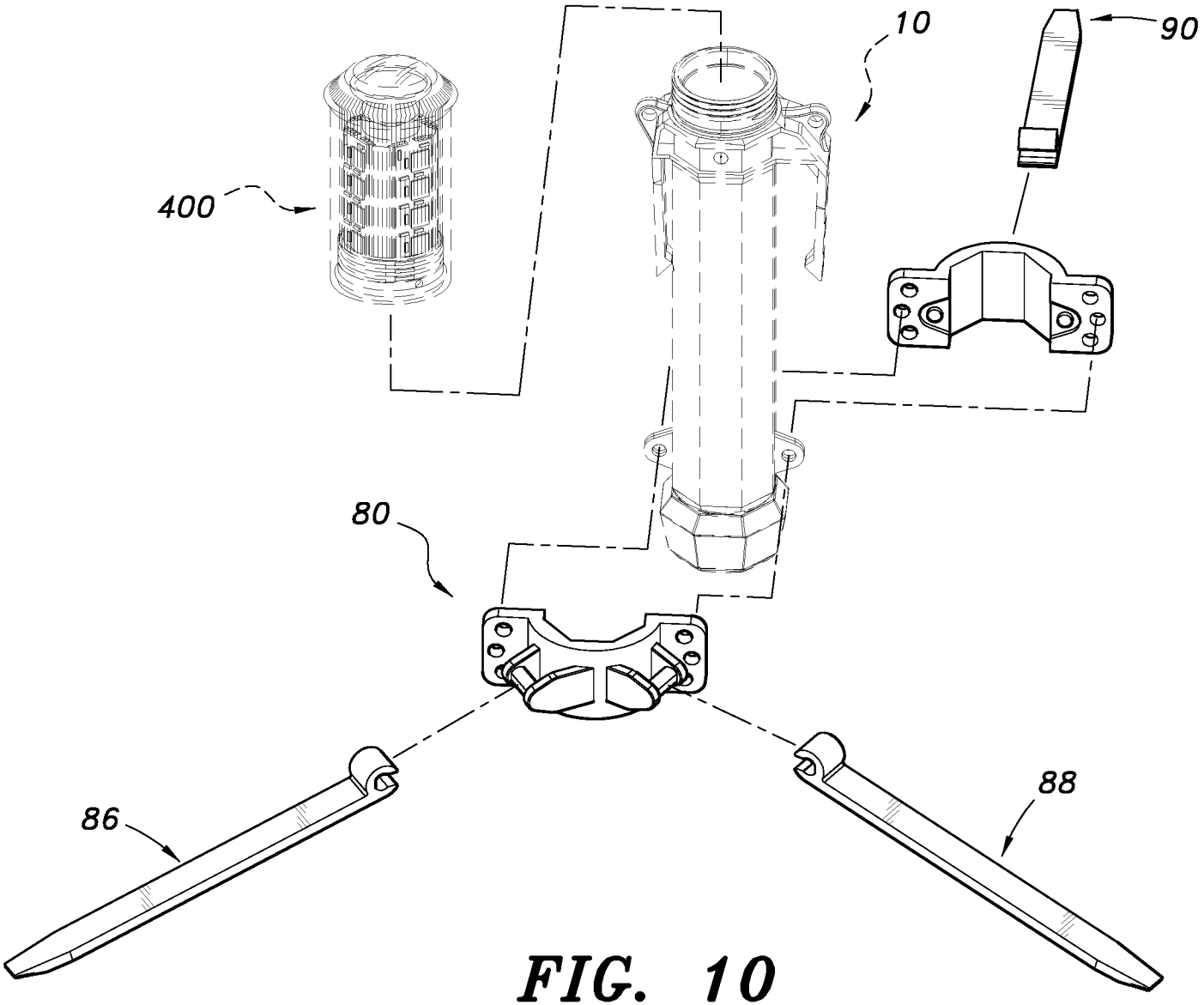
FIG. 10 is an exploded view of the invention shown in FIG. 5, and additionally showing a payload in phantom outline supported by the handle portion of the emergency light, in which the payload can be a light-emitting lamp portion.

The emergency light as shown in FIG. 10, wherein the payload 400 is a light-emitting lamp, is preferably a battery operated, multi-function LED emergency flare/flashlight/signal light/work light/lantern which is a relatively safer (no sparks, no flames, and no noxious smoke), reusable, more versatile, and more user friendly alternative to the use of incendiary strike flares which only last a maximum of 30 minutes versus an LED emergency light having 60+hours per set of batteries. Other types of light-emitting payloads P can be used, including any which would be known to any one having skill in the emergency light arts.

Figure 2:
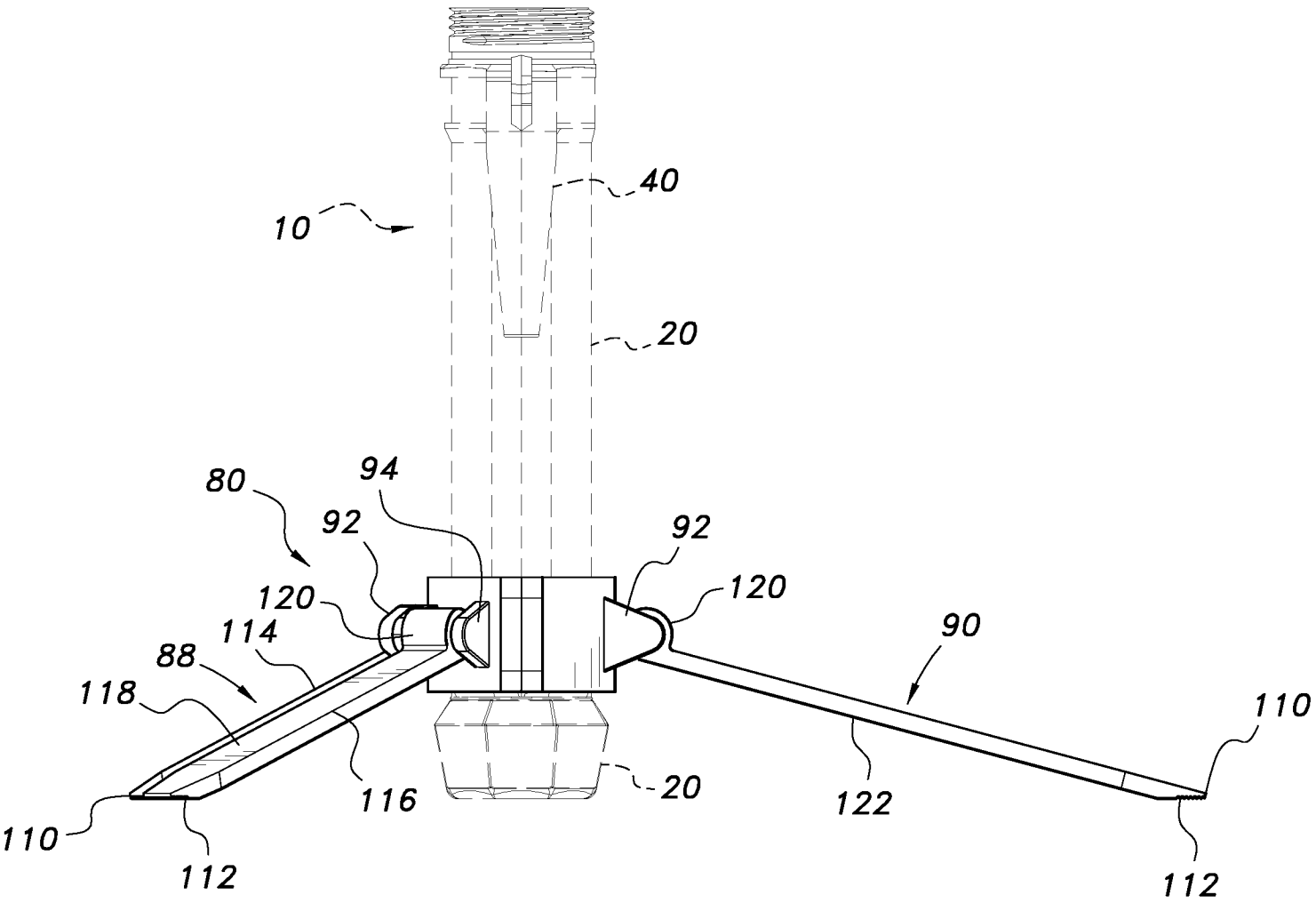
FIG. 2 is a side elevational environmental view as seen from the right of FIG. 1, showing the stable base and support of FIG. 1.

FIG. 2 is a side elevational environmental view as seen from the right of FIG. 1, showing the stable base and support 80 of FIG. 1. The leg 88 is typical of all three legs 86, 88, and 90, and has a flat portion 118 with opposed raised edges or lips 114 and 116. The leg 86 has a tip 110, and an underside 122. The end or tip 110 of the leg 86 is tapered (shown clearly with respect to the leg 90 in FIG. 2) to a point, and there are ridges on the underside 112 in the region of the tip 110.

The stable base 80 supports the handle portion 20 of the emergency light 10, having the three legs 86, 88, and 90 which can be placed selectively in any of three configurations. In a first configuration, the legs 86, 88, and 90 are generally transverse to an axis of the emergency light handle, to form a tripod-like support on approximately level ground. In a second configuration, the legs 86, 88, and 90 are disposed downwardly so as to be generally parallel to an axis of the handle portion 20 of the emergency light 10, and wherein the tips 110 of the legs 86, 88, and 90 are disposed away from the handle portion 20 of the emergency light 10, and are adapted to be inserted into the ground to form a strong immobile support to resist high winds and gusts. In a third configuration, the legs 86, 88, and 90 are raised so as to be disposed upwardly so as to be generally parallel to an axis of the handle portion 20 of the emergency light 10, and wherein the tips 110 of the legs 86, 88, and 90 are disposed adjacent to the handle portion 20 of the emergency light 10, and are adapted to be inserted into a container for storage or shipping.

Figure 3:
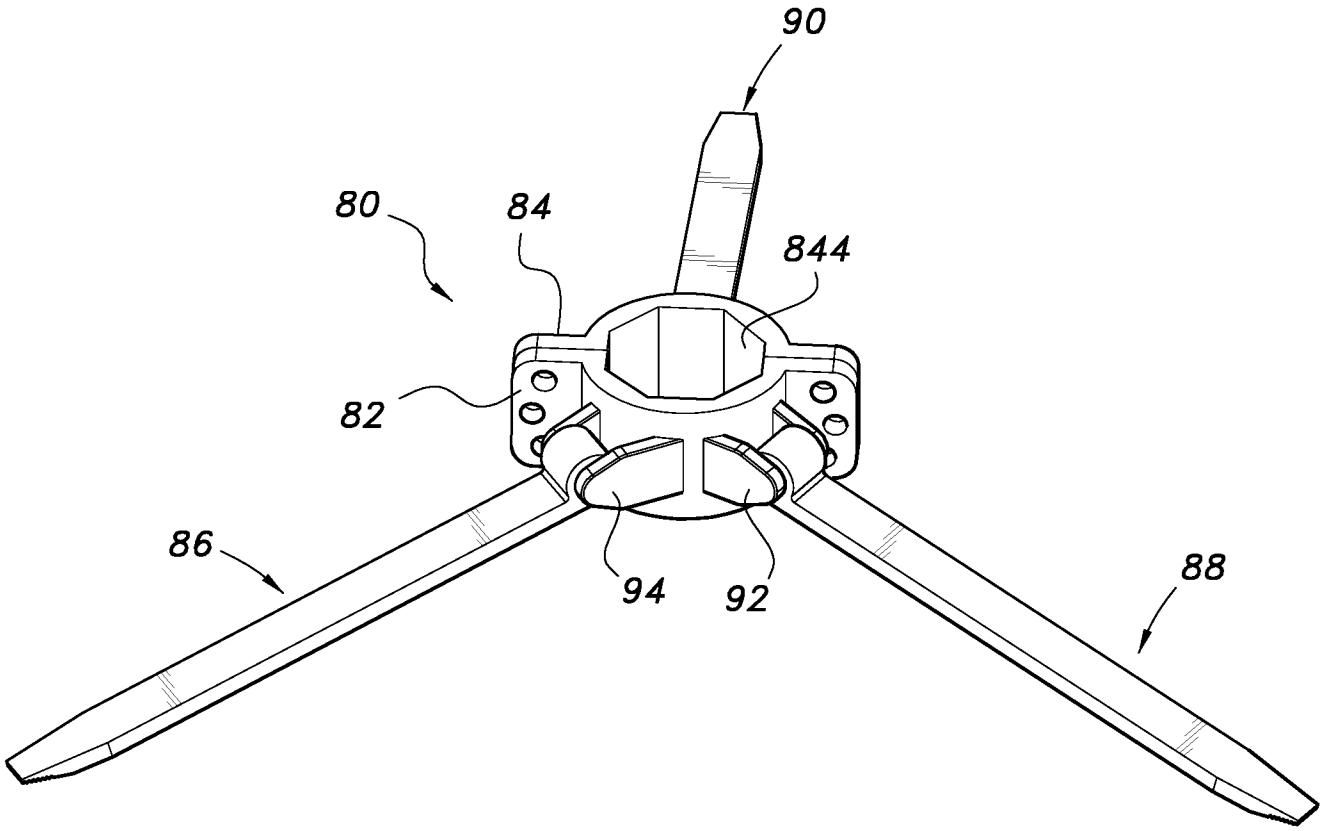
FIG. 3 is a perspective view of the stable base and support of FIG. 1.

FIG. 3 is a perspective view of the stable base and support 80 of FIG. 1.

Figure 4:
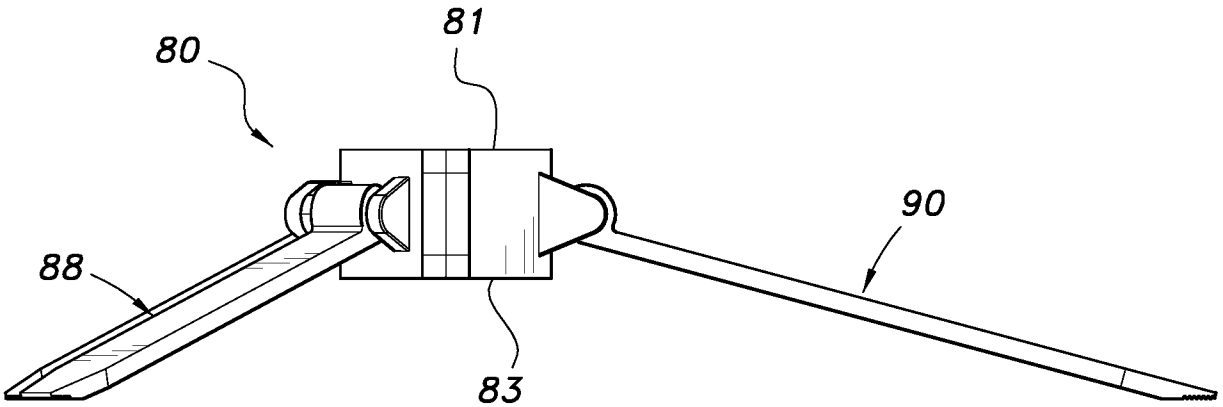
FIG. 4 is a side elevational view as seen from the right of FIG. 1, showing the stable base and support of FIG. 1.

FIG. 4 is a side elevational view as seen from the right of FIG. 1, showing the stable base and support 80 of FIG. 1.

Figure 5:
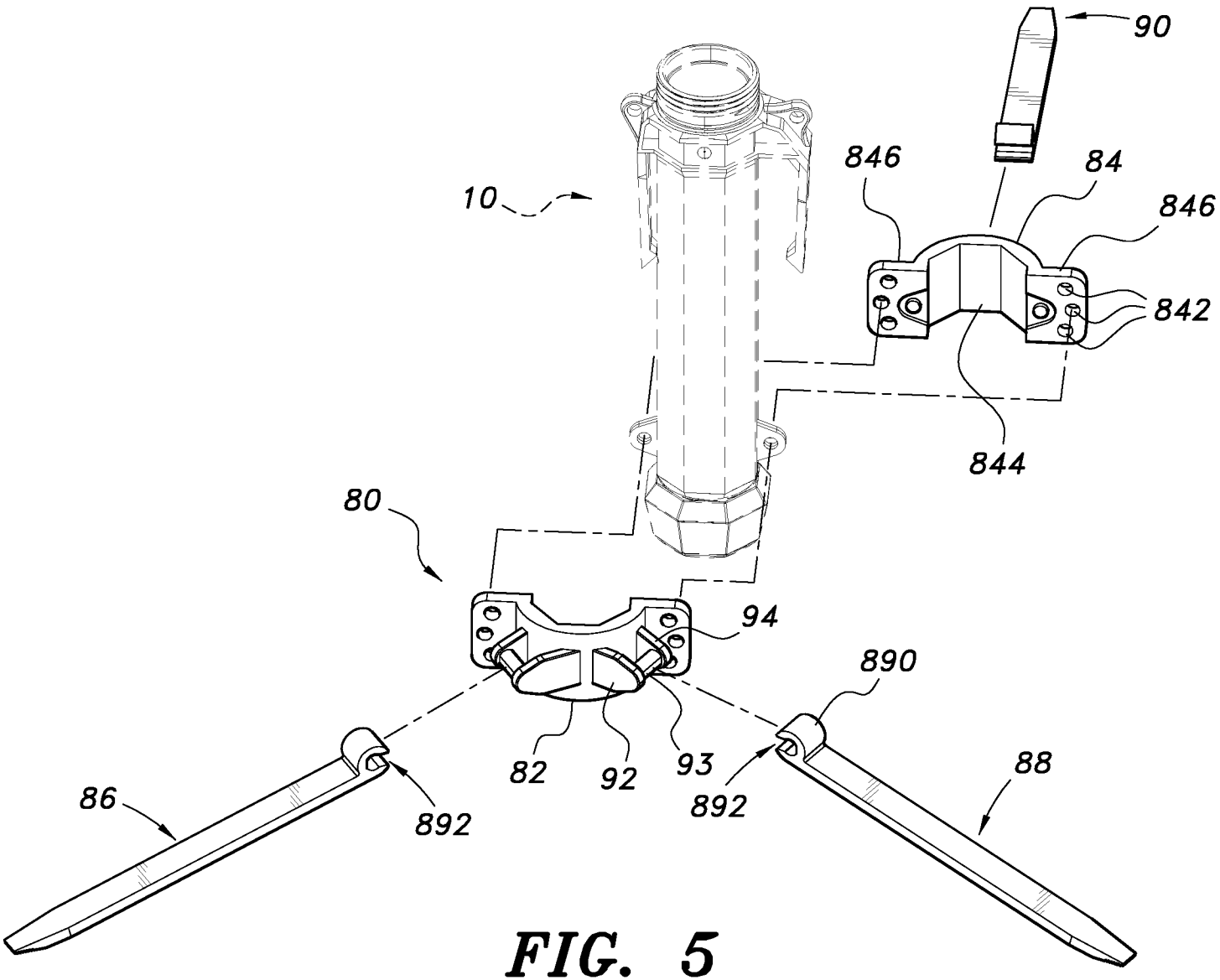
FIG. 5 is an exploded view of the invention, showing the stable base and support of FIG. 1 and showing the handle portion of the emergency light in phantom outline.

FIG. 5 is an exploded view of the invention, showing the stable base and support 80 of FIG. 1 and showing the handle portion 10 of the emergency light in phantom outline.

The bracket 82 has a first pair of tabs 92, 94 and a second pair of tabs 92, 94. The bracket 84 has a single pair of tabs 92, 94. As shown in FIG. 5, a support rod extends between each respective pair of tabs 92, 94. Each of the legs 86, 88, and 90 respectively includes a curved end 890 (shown by way of example for leg 88 in FIG. 5) having an open portion 892 adapted to receive a respective one of the rods 93, preferably by a snap fit engagement.

The curved portion 890 (shown as curved portion 120 in FIG. 2) are rounded, and can retain the respective leg in position due to frictional engagement with the adjacent surface of the respective bracket. Alternatively, the legs and be placed in the three configurations discussed herein by removal of the legs from the pins and reattachment of the legs to the pins after relocating the legs into the desired configuration.

The bracket 84 has an inner surface 844 having three flat portions for mating with the exterior of the handle portion 10, and the bracket 82 has substantially identical flat portions for mating with the exterior of the handle portion 10. The bracket 84 includes a pair of wing portions 846, 846, each of the wing portions 846 having three bores or holes 842 therethrough. The bracket 82 has a similar pair of wing portions (unnumbered in FIG. 5) and corresponding bores or holes (unnumbered in FIG. 5). The uppermost hole 842 and the lowermost hole 842 are preferably used for passage of bolts to secure the bracket 84 to the bracket 82. The middle bore or hole 842 is preferably used to secure one end of a strap, the strap having a second end for engagement with one of the holes (unnumbered) in the handle portion 10, the strap being used for manually carrying the base 80 and emergency light 10 of FIG. 1.

The leg 86 has a curved end 892 adapted to be mounted on the rod 93, such as by a snap fit, such that the leg 86 is pivotable about the rod 93. The Similarly, the leg 88 has a curved end 890, likewise pivotably supported by a respective one of the rods 93, and the leg 90 has a curved portion (unnumbered) which is likewise pivotably supported by a respective one of the rods 93. The tabs 92, 94 serve to support the rod 93.

Figure 6:
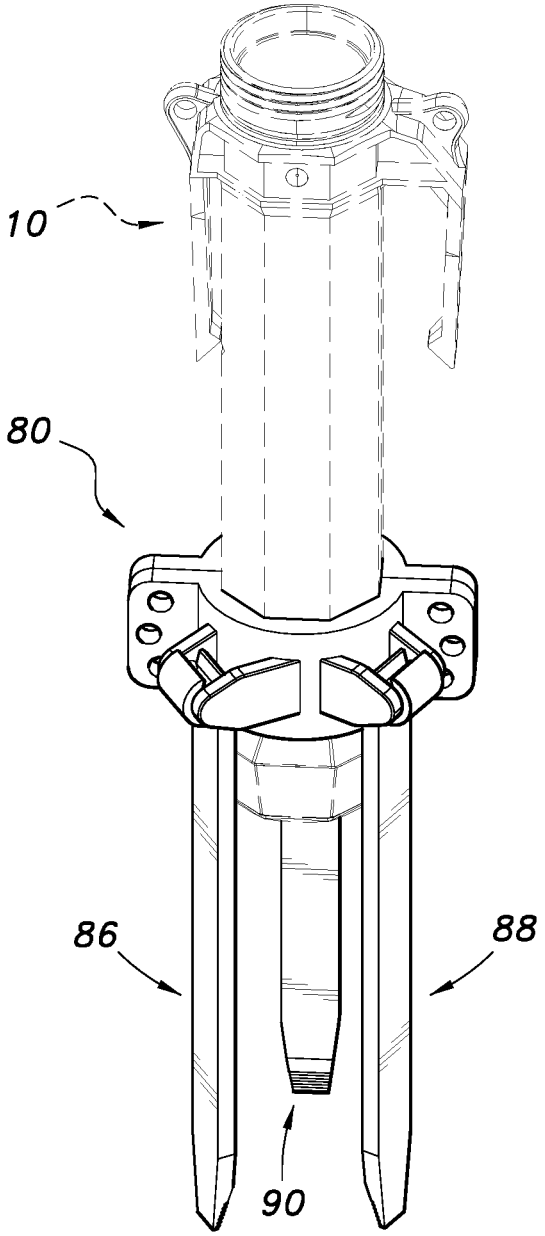
FIG. 6 is a perspective environmental view of the stable base and support of FIG. 1, the stable base being in a second configuration with its legs downwardly directed for insertion into the ground, according to the present invention.

FIG. 6 is a perspective environmental view of the stable base and support 80 of FIG. 1, the stable base 80 being in a second configuration with its legs 86, 88, and 90 being downwardly directed for insertion into the ground, according to the present invention.

Figure 7:
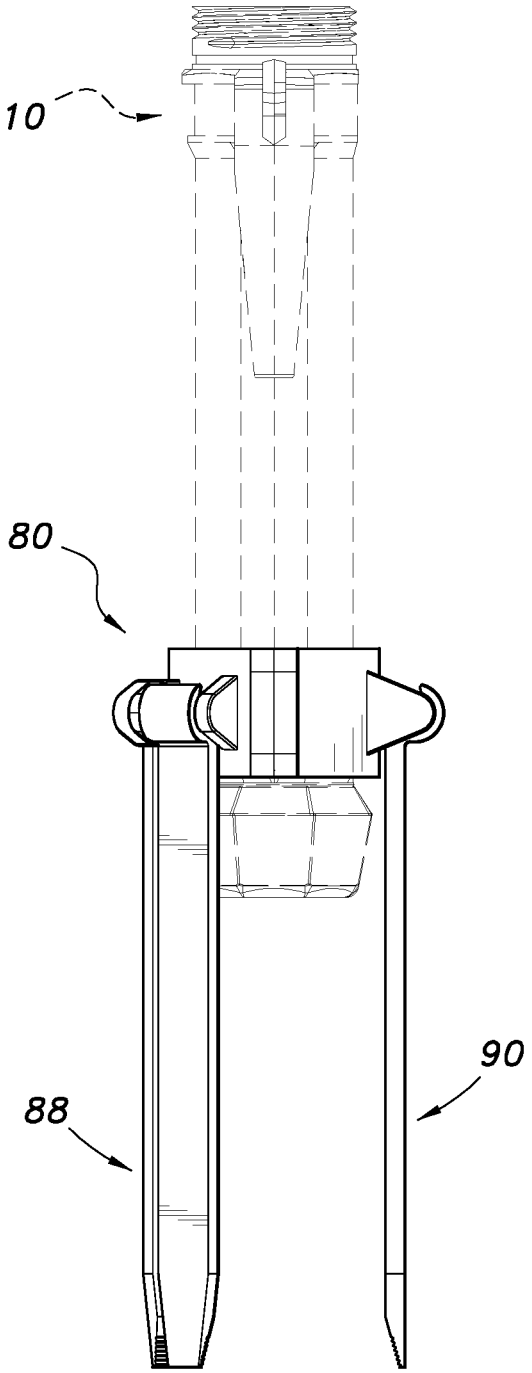
FIG. 7 is a side elevational environmental view as seen from the right of FIG. 6, showing the stable base and support of FIG. 1 in the second configuration.

FIG. 7 is a side elevational environmental view as seen from the right of FIG. 6, showing the stable base and support 80 of FIG. 1 in the second configuration.

Figure 8:
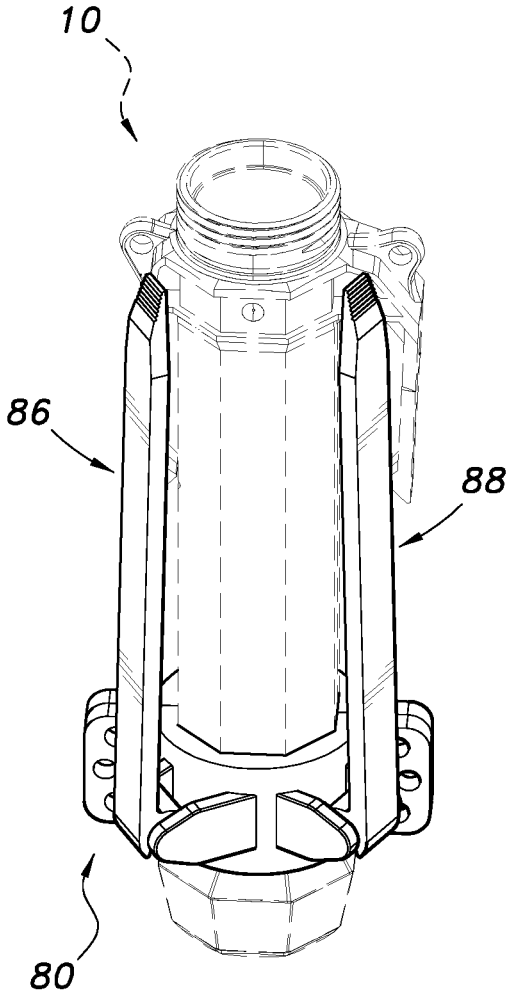
FIG. 8 is a perspective environmental view of a stable base and support for a device such as a handle portion of an emergency light which is shown in phantom outline, the stable base being in a third configuration with its legs upwardly directed such that they are adjacent the handle portion of the emergency light, the third configuration being adapted for storage and for ease of handling, according to the present invention.

FIG. 8 is a perspective environmental view of a stable base and support 80 for a device such as a handle portion of an emergency light 10 which is shown in phantom outline, the stable base 80 being in a third configuration with its legs 86, 88, 90 being upwardly directed such that they are adjacent the body portion 20 of the handle portion 10 of the emergency light, the third configuration being adapted for storage and for ease of handling, according to the present invention.

Figure 9:
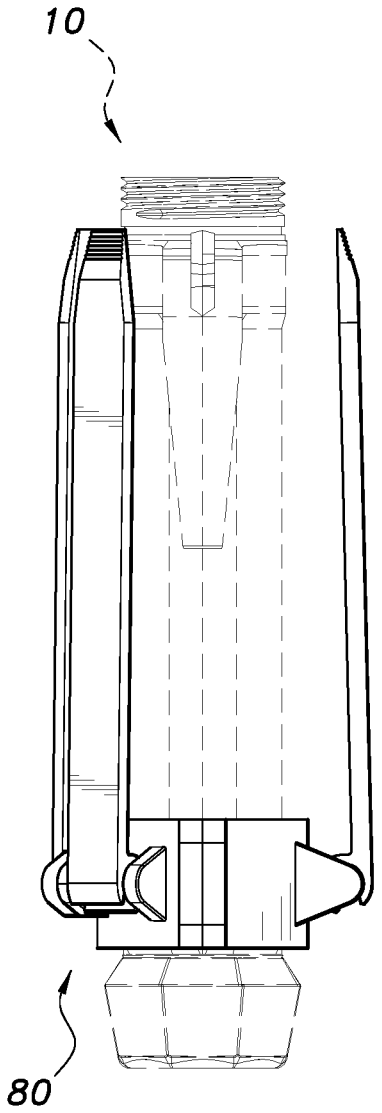
FIG. 9 is a side elevational environmental view as seen from the right of FIG. 8, showing the stable base and support of FIG. 1 in the third configuration.

FIG. 9 is a side elevational environmental view as seen from the right of FIG. 8, showing the stable base and support 80 of FIG. 1 in the third configuration.

FIG. 10 is an exploded view of the invention shown in FIG. 5, and additionally showing a payload 400 in phantom outline supported by the uppermost threaded portion 12 of the handle portion 10 of the emergency light, in which the payload 400 can be a light-emitting lamp portion.

Figure 11:
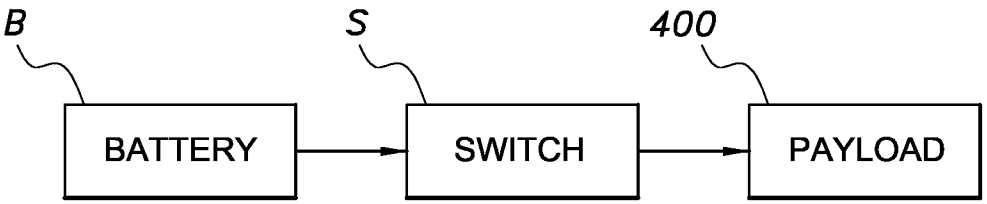
FIG. 11 is a schematic diagram of a circuit having a battery, switch, and the payload of FIG. 10, such that the battery is housed in the handle portion of the emergency light, and wherein the switch is mounted on the handle portion, so as to selectively power the payload which can be a light-emitting lamp portion.

FIG. 11 is a schematic diagram of a circuit having a battery B, a switch S, and the payload 400 of FIG. 10, such that the battery B is housed in the handle portion 10 of the emergency light, and wherein the switch S is mounted on the handle portion 10, so as to selectively power the payload 400 which can be a light-emitting lamp portion.

The payload 400 can be a transparent housing covering light-emitting LEDs, and wherein the top edge of the transparent housing preferably includes a lip (not shown). This lip can exist can have a structure extending outwardly, so that it can support or secure items usable with the emergency light such as a red cone so as to be able to use the light as a traffic wand by switching to the flashlight mode along with the red cone. And, the lip can be used to secure an additional battery powered light source, audible alarm, GPS, and/or other devices or items.

Figure 12:
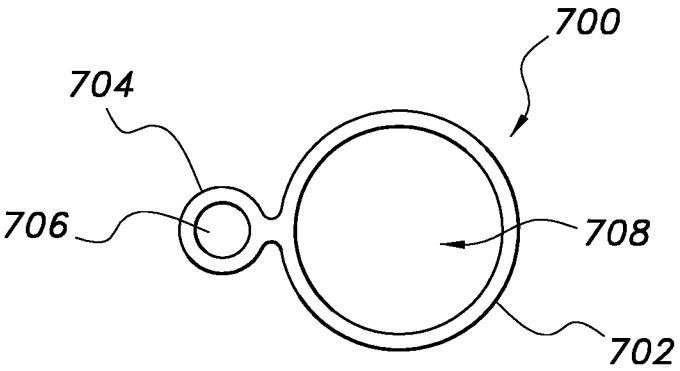
FIG. 12 is a top elevational view of a support member for attaching the handle portion of the emergency light to a traffic cone, the support member including a large loop portion attached to a small loop portion, wherein the large loop portion receives the tip of a traffic cone and the small loop portion receives an arm of the handle portion.

FIG. 12 is a top elevational view of a support member 700 for attaching the handle portion 10 of the emergency light to a traffic cone (not shown), the support member 700 including a large loop portion 702 attached to a small loop portion 704, wherein the large loop portion 702 receives the tip of a traffic cone (not shown) and the small loop portion 704 receives one of the arms 40 and 50 of the handle portion 10. The large loop portion 702 has an opening 708, and the small loop portion 704 has an opening 706. The support member 700 can be formed as a flat thin sheet, or it can have a cylindrical cross section such as a wire shape.

The emergency light of FIG. 10 preferably stands 12 inches tall in order to be seen over greater distances and varying terrain. Unlike other led flares on the market, this unit has an easily removed threaded lens for easy field replacement. The design of the lens allows for a tight fit against the parabolic reflector of the top mounted flashlight so as to prevent light scatter. An aluminum LED module under the lens is also removable for easy field replacement if it should be damaged or if the user would like to use a different led color module. This module can be changed out by simply removing the lens and a set screw which is located on the opposite side from the push button and just above the black O-ring.

The side facing led's (of the light-emitting portion of the payload 400) can be single color or bi-color. There is also a 3 watt led on the top of the module along with a parabolic reflector to act as a powerful flashlight. The various functions of this product are operated through the use of a single push button located just below the clear lens.

The body portion 20 has an octagon shape to allow for a much more comfortable hand grip as well as to keep the unit from rolling if set down.

On the body portion 20, the clip 50 is close to the body and is used as a belt clip. The other clip, clip 40, is extended approximately one inch off the side of the body and has a primary purpose of being hooked through the hole at the top of a traffic cone should the user not want to use the optional traffic cone ring 700.

There are also four small body loops or bores, two upper and two lower, for the attachment of an optional shoulder strap or hand strap (not shown).

A battery cap (i.e., the bottom or top cover of the body portion 20) is also octagon shaped just as the body so as to help prevent rolling.

Figure 13:
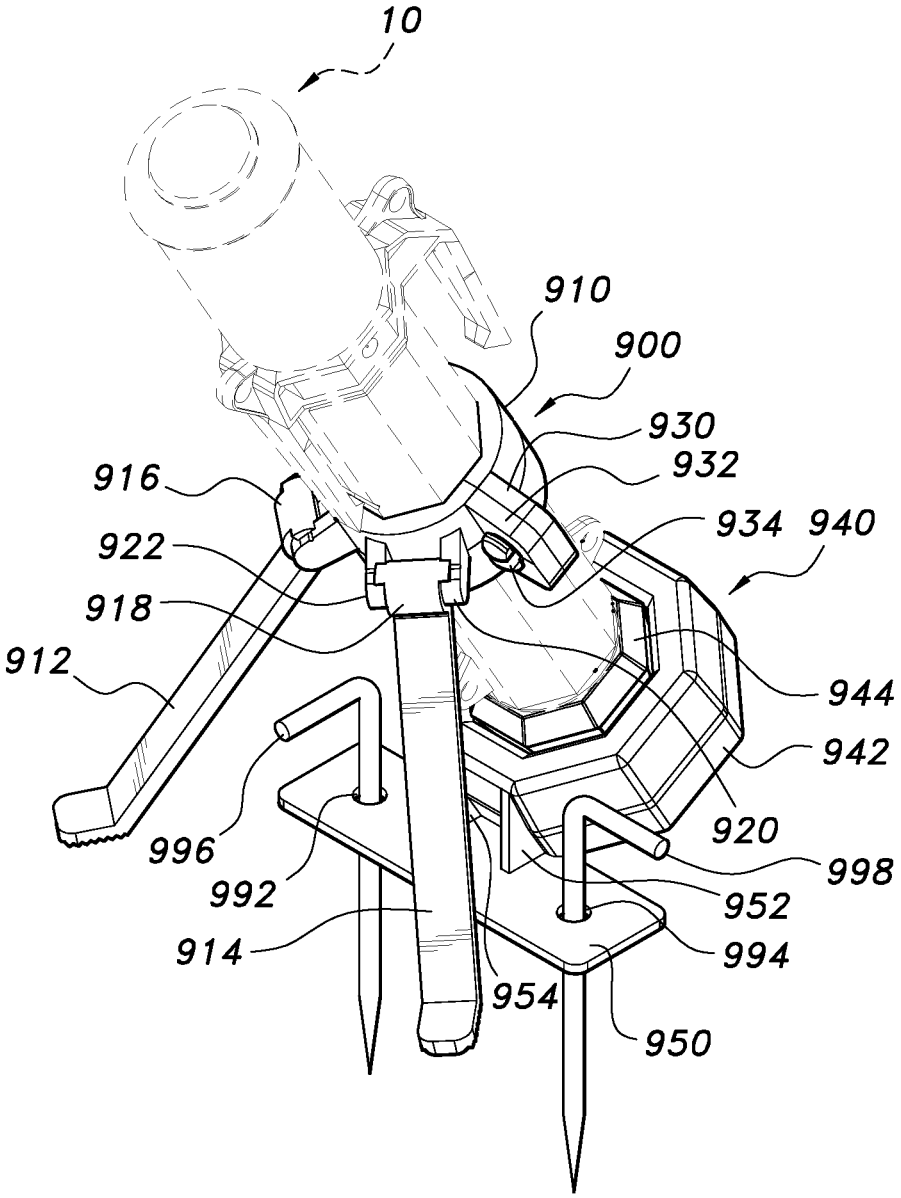
FIG. 13 is a perspective view from above showing the front and left of a further embodiment of the present invention showing an improved support for the handle portion of FIG. 1, the improved support having a base portion and a stand portion showing with the handle portion in phantom outline.

FIG. 13 is a perspective view from above showing the front and left of a further embodiment of the present invention showing an improved support for the handle portion 10 of FIG. 1, the improved support having a base portion 940 and a stand portion 900 showing the handle portion 10 in phantom outline.

Figure 14:
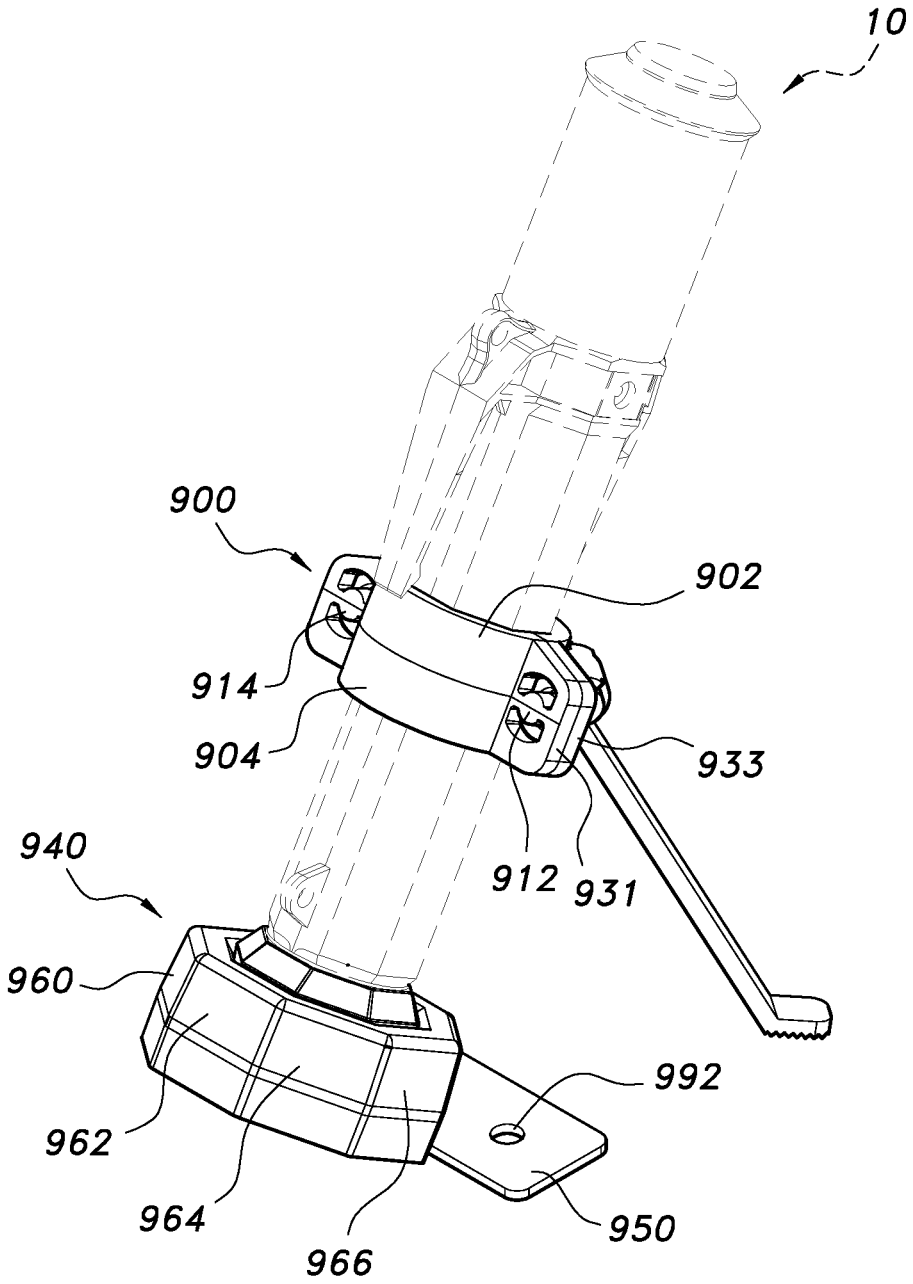
FIG. 14 is a perspective view from above showing the rear and right of the further embodiment of FIG. 13, showing the improved support for the handle portion of FIG. 1, the improved support having a base portion and a stand portion showing with the handle portion in phantom outline.
Figure 17:
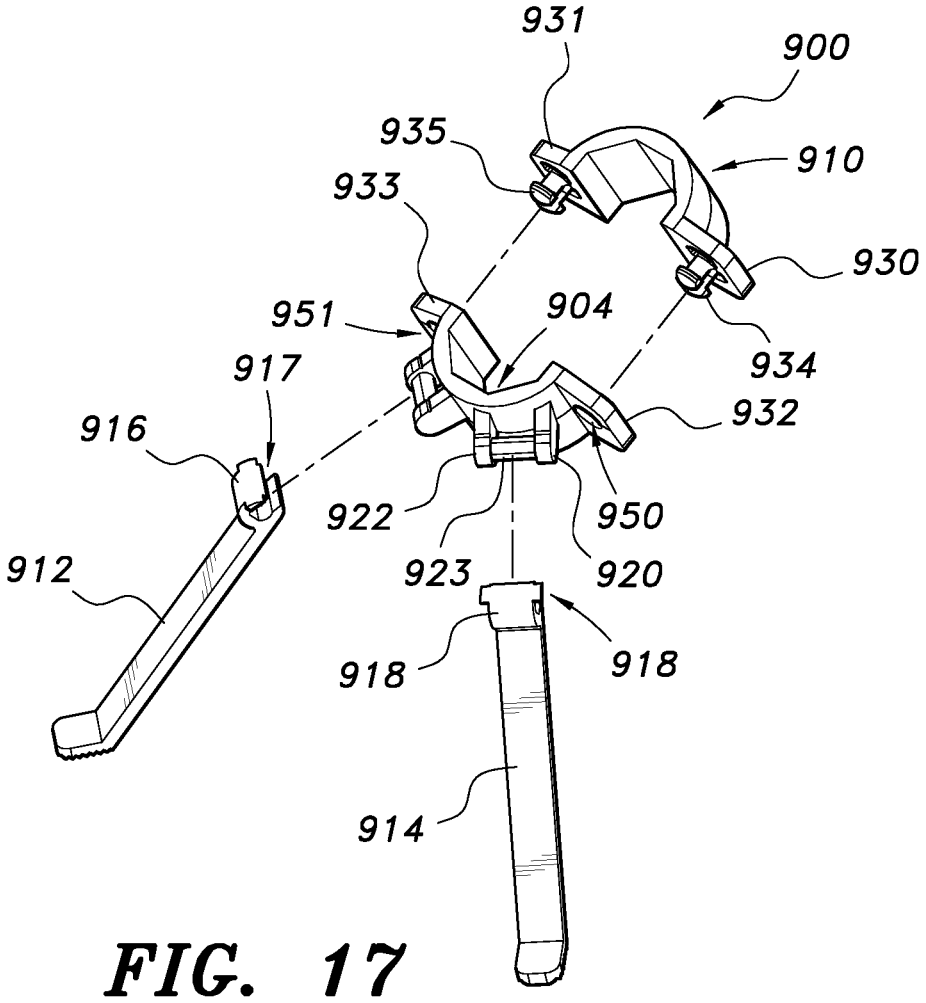
FIG. 17 is an exploded front left perspective view from above of the stand portion of FIG. 16.

As shown in FIG. 13, the stand portion 900 has a first body portion 910 which supports an ear portion 930 (shown in FIG. 13) and a second ear portion 931 (shown in FIG. 17), and as shown in FIG. 14 and in FIG. 17 the stand portion 900 includes a second body portion 904. The second body portion 904 supports a first ear portion 932 (shown in FIG. 13) and a second ear portion 933 (shown in FIG. 17). The first body portion 910 is also referred to herein as a rear facing portion 910, and the second body portion 904 is also referred to herein as a front facing portion 904.

The first ear portion 932 of the front facing portion 904 has an opening 950 therethrough adapted to receive the fastener 934, and the second ear portion 933 of the front facing portion 904 (shown in FIG. 17) has an opening 951 therethrough adapted to receive a fastener 935 (shown in FIG. 17).

The first ear portion 930 of the rear facing portion 910 supports the fastener 934, and as shown in FIG. 17 the second ear portion 931 of the rear facing portion 910 supports the fastener 935. The fasteners 934 and 935 each respectively include a pair of prongs (unnumbered) with respective head portions (unnumbered), so that during assembly the prongs can resiliently deform to allow passage of the head portions through an aperture, and after passage the prongs can resiliently expand so that the head portions prevent retraction of the prongs through the aperture. Such fasteners are well known in the fastener art, and the present invention is not limited thereto and can include any fastener which would be known to any one having skill in the fastener arts.

When being assembled, the fasteners 934 and 935 deform resiliently slightly to pass through the respective openings 950 and 951, and then expand resiliently slightly so that the headed portions expand to prevent retraction (as explained above) so that the first body portion 910 is secured to the second body portion 904. The ear portions 930 and 932 are thereby held together with the fastener 934, and the ear portions 931 and 933 are thereby held together with the fastener 935. The fastener 934 is preferably integral with the ear 930, though other constructions are possible such as forming the fastener 934 separately and then securing it (as by threading or ultrasonic welding or adhesive, for example) to the ear 930. All such constructions are contemplated as being within the scope of the present invention.

It will be understood that the stand portion 900 is symmetrical, and therefore the parts described and shown in FIG. 13 will likewise be present on the opposite side and therefore need not be further described in detail herein.

The second body portion 904 has an upper portion 902. The second body portion 904 has a first pair of hinge elements 920 and 922, which support a proximal end 918 of a first leg 914. A crossbar 923 extends between the pair of hinge elements 920 and 922, to receive said proximal end 918 of the first leg 914, as shown in FIG. 17. The proximal end 918 of the first leg 914 has an opening 918 to receive the crossbar 923, the proximal end 918 being resiliently deformable so that a snap fit engagement takes place when assembling the proximal end 918 of the first leg 914 onto the crossbar 923. The second pair of hinge elements likewise have a crossbar (shown in FIG. 17 and unnumbered) received by an opening 917 in the proximal end 916 of the second leg 912.

The components shown can be formed of plastic, metal, or any other materials which would be known to any one having skill in the stand arts and the flashlight arts.

As discussed above, the second pair of hinge elements (unnumbered in FIGS. 13 and 17) identical to the first pair of hinge elements, supports a second leg 912, the second leg 912 having a proximal end 916, the end 916 likewise serving as a hinge element to allow pivoting of the second leg 912.

The assembled first body portion 910 and the second body portion 904 secure the handle portion 10 therebetween.

The base portion 940 receives and secures a bottom of the handle portion 10 therein. An upper base portion 944 is shown in FIG. 13, which corresponds to the body portion 20 of the handle portion 10 of FIG. 1, the upper base portion 944 serving as a battery cover 944 of the flashlight, and this terminology will be used hereunder.

The base portion 940 has a lower base portion 942 and the upper base portion 944, a front portion of the lower base portion 942 having ribs 954 and 952, and a plate 950 is secured to the ribs 954 and 952.

Figure 15:
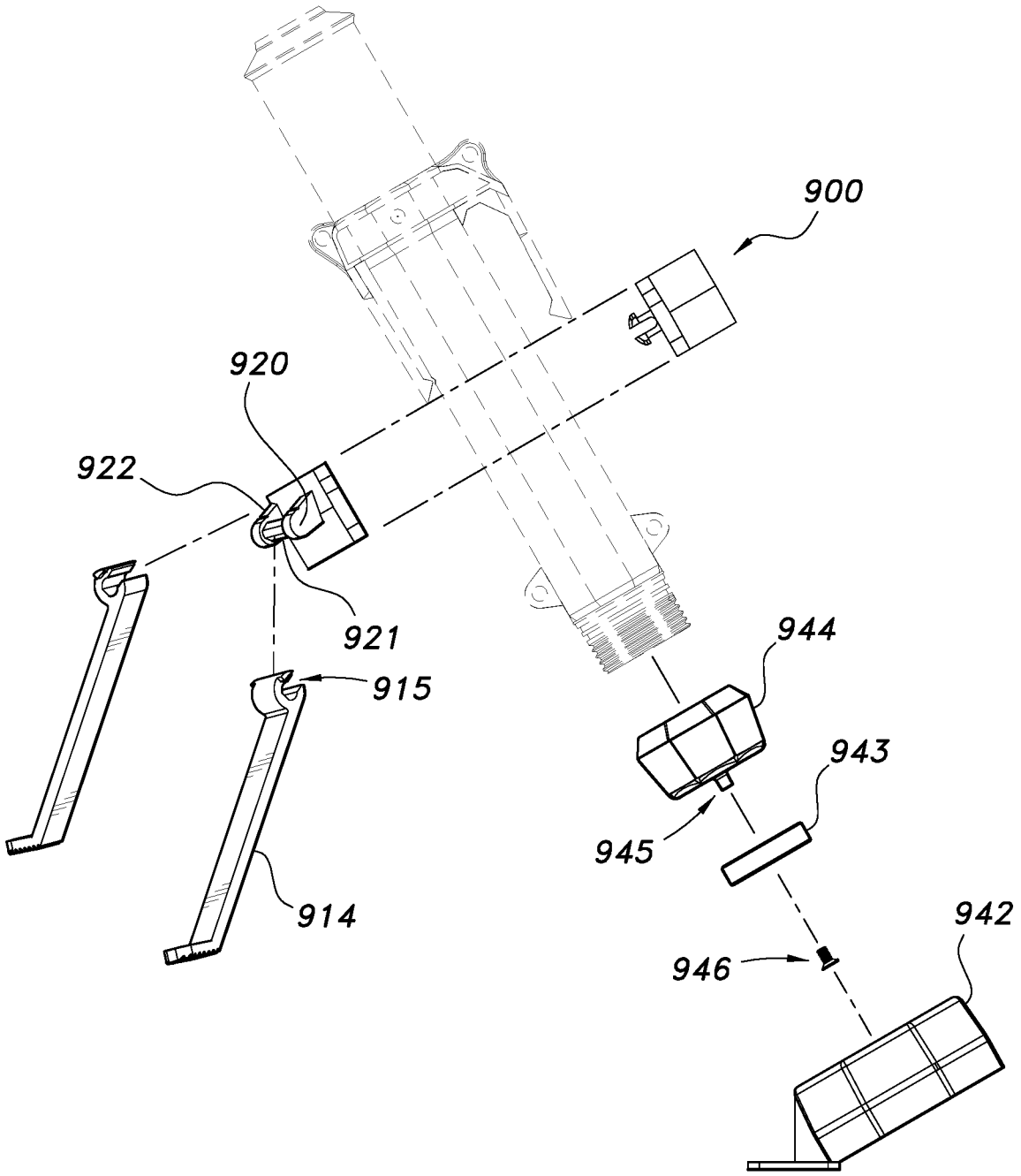
FIG. 15 is an exploded perspective view of the embodiment of FIGS. 13 and 14.

The upper base portion 944 is the battery cover of the handle portion 10, and—as noted above—corresponds to the to the body portion 20 of the handle portion 10 of FIG. 1. The embodiment of FIG. 13 differs from that of FIG. 1, and the change of terminology is provided for the sake of clarity and to avoid confusion. As seen in FIG. 15, the upper base portion 944 is mounted by threading shown in the phantom outline of lowermost end of the handle portion 10. The upper base portion 944 has internal threading (shown in FIG. 19) to enable this threaded connection.

The plate 950 has an opening 994 and an opening 992 therethrough. A first spike 996 can be inserted through the opening 992, and the spike 996 can be hammered into the ground or pavement to secure the base portion 940 in place. Likewise, a second spike 998 can be inserted through the opening 994, and the spike 998 can be pushed or hammered into the ground or pavement to secure the base portion 940 in place. The spikes 996 and 998 are preferably composed of metal that is sufficiently strong to be inserted into the ground or pavement without breaking.

The base portion 940 is described further below with regard to FIGS. 14, 15, 17, 18, and 19.

FIG. 14 is a perspective view from above showing the rear and right of the further embodiment of FIG. 13, showing the improved support for the handle portion 10 of FIG. 1, the improved support having the base portion 940 and the stand portion 900 shown with the handle portion 10 in phantom outline. As seen in this view, the ear portions have respective center portions 912 and 914 as viewed from the rear.

The base portion 940 has flat surfaces 960, 962, 964, and 966 as seen in FIG. 14. Other flat unnumbered flat surfaces are shown in the front view of FIG. 13, and are included for ease of handling and cleaning, and to prevent rolling when on its side, for example before and after assembly/disassembly.

FIG. 15 is an exploded perspective view of the embodiment of FIGS. 13 and 14, showing the stand portion 940 and the base portion 940. The base portion 940 includes the lower base portion 942; the upper base portion 944, a projecting portion 945 extending below the upper base portion 944 and adapted to receive a threaded fastener 946 therein; and a battery end cap 943 which is a magnetic member 943; the battery end cap 943 having an opening therethrough to allow passage of the threaded fastener 946 which secures the battery end cap 943 to the battery cover 944.

The battery end cap 943 is mounted by the fastener 946 to the upper base portion 944 (i.e., the battery cover 944). The battery end cap 943 is preferably a magnet, to allow the handle portion 10 to be mounted to the metal side of a vehicle by magnetic attraction, which can be very useful during an emergency. The battery end cap 943 is preferably composed of a magnetic material which is Neodymium; other types of magnetic material and magnets which would be known to any one having skill in the magnetic material arts are also contemplated as being within the scope of the present invention.

The battery end cap 943 is disposed between the lower base portion 942 and the upper base portion 944, and the upper base portion 944 is secured within the lower base portion 942 by frictional engagement, as explained below.

The lower base portion 942 is preferably composes of a resilient material, which in the preferred embodiment is TPV material. This TPV material is a rubber-like material. In the preferred embodiment of FIGS. 13-19, the lower base portion 942 is a cup-like member that is resiliently deformable to tightly receive the upper base portion 944 therein such that the upper base portion 944 is frictionally retained within the lower base portion 942.

It is contemplated that other materials can be used for the material of the lower base portion 942, including rubber, ABS, polycarbonate, silicone, and any other materials which would be known to any one having skill in the resilient material arts. This construction enables easy removal of the battery cover for changing batteries, for example.

Although a frictional engagement is mentioned above, in a further embodiment the upper base portion 944 can be secured permanently to the lower base portion 942 by threaded engagement or by adhesive, ultrasonic welding, or other securement means known to any one having skill in the assembly arts.

Figure 16:
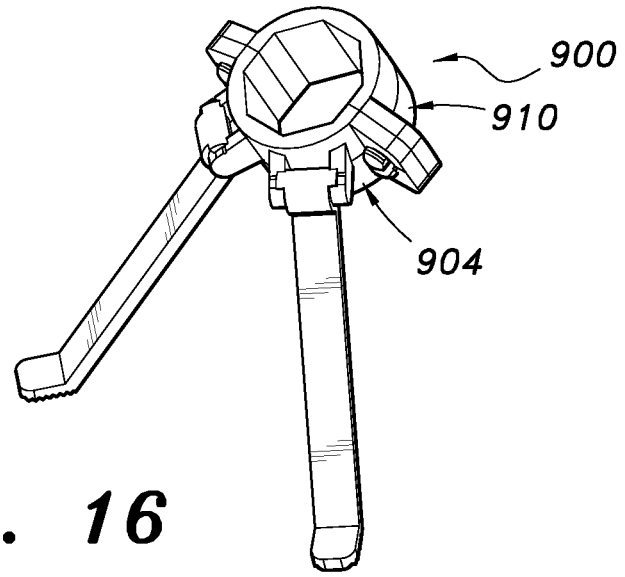
FIG. 16 is a front left perspective view from above of the stand portion by itself, similar to that of FIG. 13.

FIG. 16 is a front left perspective view from above of the stand portion 900 by itself, similar to that of FIG. 13.

FIG. 17 is an exploded front left perspective view from above of the stand portion 900 of FIG. 16. The components shown in this view are as described hereinabove.

Figure 18:
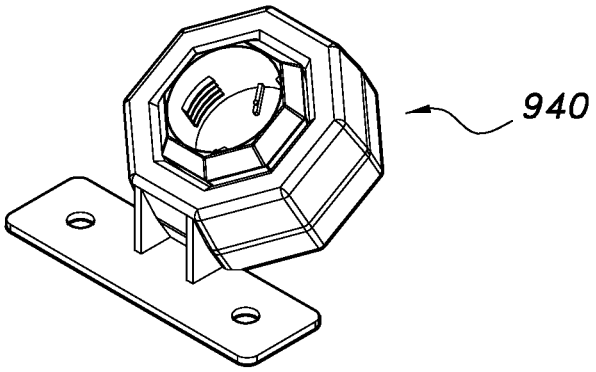
FIG. 18 is a front left perspective view from above of the base portion by itself, similar to that of FIG. 13.

FIG. 18 is a front left perspective view from above of the base portion 940 by itself, similar to that of FIG. 13. In this view, a cavity 968 is shown in the upper base portion 944 of the base portion 940 (shown in FIGS. 18 and 19). The cavity 968 is sized to receive the threaded lower most end of the handle portion 10 (shown in FIG. 13), and has threading 969 that mates with the threading shown in the above-mentioned lowermost end of the handle portion 10 shown in dashed outline.

Thus, FIG. 18 shows how the upper base portion 944 (serving as the battery cover for the handle portion 10) is received within the lower base portion 942.

The plate 950 is preferably molded as one piece with the lower base portion 942.

Figure 19:
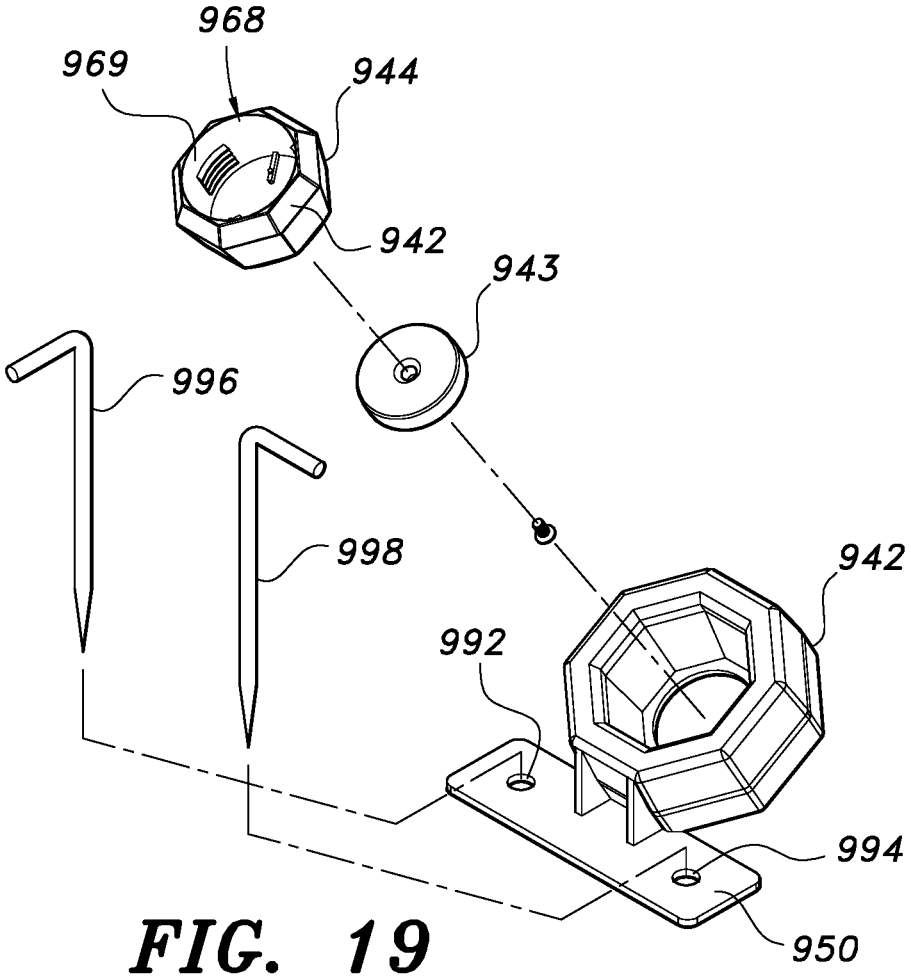
FIG. 19 is an exploded front left perspective view from above of the base portion of FIG. 18.

FIG. 19 is an exploded front left perspective view from above of the base portion 942 of FIG. 18, including the upper base portion 944, the battery end cap 943, and the lower base portion 942. The spikes 996 and 998 are also shown. The spikes can be used when securing the device in heavy winds, and for use nearly helicopter landing areas.

In the embodiment of FIGS. 13-19, a first configuration, the legs are generally transverse to an axis of the emergency light handle, to form a tripod-like support on approximately level ground. In a second configuration, the legs are disposed downwardly so as to be generally parallel to the axis of the handle portion, such that the tips of the legs are disposed downward and are adapted to be inserted into the ground to resist high winds and gusts. In a third configuration, the legs are raised upward such that the tips of the legs are disposed adjacent to the handle portion of the emergency light, and are adapted to be inserted into a container for storage or shipping.

The present invention covers all variations in size and shape, that would be known to any one having skill in the flashlight arts.

The invention being thus described, it will be evident that the same may be varied in many ways by a routineer in the applicable arts. Such variations are not to be regarded as a departure from the spirit and scope of the invention and all such modifications are intended to be included within the scope of the invention.

What is claimed is:

1. A stable base for supporting an emergency light in an upright leaning position on a surface, comprising in combination:

a handle portion of the emergency light, said handle portion having an upper end, a lowermost end, a central portion disposed between said upper end and said lowermost end; and said handle portion having a longitudinal axis;

a stand portion adapted to support said handle portion in an upright leaning position; said stand portion having a first body portion and a second body portion; said second body portion having two legs adapted to support said handle in an upright leaning position when said stand is mounted on said central portion of said handle portion; said first body portion and said second body portion being disposed on opposite sides of said central portion of said handle portion; and at least one fastener for connecting said first body portion to said second body portion, to retain said central portion of said handle portion between said first body portion and said second body portion; and a base portion adapted to receive said lowermost end of said handle portion to support said handle portion on the support surface;

said handle portion having a hanging position, said two legs being adapted for hanging said handle portion on any environmental object capable of being engaged by one of the arms.

2. A stable base as claimed in claim 1, said base portion comprising an upper base portion and a lower base portion.

3. A stable base as claimed in claim 1, said base portion comprising an upper base portion adapted to be a battery cover, a battery end cap connected to said upper base portion, and a lower base portion.

4. A stable base as claimed in claim 3, wherein said lowermost end of said handle portion has external threading; and wherein said upper base portion has internal threading adapted for threaded engagement with said threaded lower end of said handle portion, to secure said handle portion to said upper base portion.

5. A stable base as claimed in claim 3, wherein said lower base portion is cup-shaped and receives said battery cover in frictional engagement therein.

6. A stable base as claimed in claim 3, wherein said battery cover has a polygonal surface, to prevent rolling of the battery cover when lying on the surface.

7. A stable base as claimed in claim 3, wherein said battery cover is a magnetic member, adapted to secure said handle portion to a metallic surface when said handle portion is separated from said lower base portion.

8. A stable base as claimed in claim 3, wherein said lower base portion is composed of TPV material, and is resiliently deformable to grip and retain said battery cover.

9. A stable base as claimed in claim 1, wherein said stand portion has a first configuration and a second configuration; where in said first configuration said at least two legs are extended away from said handle portion to provide a stable base, and in said second configuration said at least two legs are pivoted toward said handle portion and extend generally parallel to said longitudinal axis of said handle portion.

10. A stable base as claimed in claim 1, wherein said second body portion of said stand portion includes a first pivot portion and a second pivot portion which respectively support said two legs pivotably in relation to said handle portion.

* * * * *